United States Patent [19]

Nitta

[11] 4,451,229

[45] May 29, 1984

[54] LIQUEFIED GAS LIGHTER WITH BALL-POINTED PEN

[76] Inventor: Masao Nitta, 322 Nagasaki, Shimizu-shi, Shizuoka-ken, Japan

[21] Appl. No.: 482,977

[22] Filed: Apr. 7, 1983

[30] Foreign Application Priority Data

Sep. 20, 1982 [JP] Japan ..... 57-142485[U]

[51] Int. Cl.[3] ..... F23D 21/00

[52] U.S. Cl. ..... 431/253; 401/52

[58] Field of Search ..... 431/253; 206/85, 86; 131/178, 185; 401/52

[56] References Cited

U.S. PATENT DOCUMENTS

| | | | |
|---|---|---|---|
| 1,342,838 | 6/1920 | Aronson | 431/253 |
| 1,871,898 | 8/1932 | Manheimer | 431/253 |
| 1,975,531 | 10/1934 | Aronson | 401/52 |
| 2,308,225 | 1/1943 | Edenburg | 431/253 |
| 3,150,507 | 9/1964 | Smith | 431/253 |

FOREIGN PATENT DOCUMENTS

| | | | |
|---|---|---|---|
| 170593 | 7/1916 | Canada | 431/253 |
| 806411 | 6/1951 | Fed. Rep. of Germany | 401/52 |
| 1095033 | 12/1960 | Fed. Rep. of Germany | 431/253 |
| 963974 | 7/1950 | France | 431/253 |
| 981486 | 5/1951 | France | 431/253 |

*Primary Examiner*—Samuel Scott
*Assistant Examiner*—Margaret A. Focarino
*Attorney, Agent, or Firm*—Wenderoth, Lind & Ponack

[57] ABSTRACT

A liquefied gas lighter with a ball-pointed pen which comprises a housing defining a fuel reservoir having an engaging projection extending along one side thereof, a ball-pointed pen casing detachably connected to the reservoir and having a mating recess extending along one side thereof for receiving the engaging projection and a guide slot extending along the side thereof opposite from the one side, a ball-pointed pen received in the casing for movement in the opposite directions therein and a pen pusher member slidably received on the pen and having an integral operation handle projecting outwardly through the guide slot.

6 Claims, 4 Drawing Figures

LIQUEFIED GAS LIGHTER WITH BALL-POINTED PEN

BACKGROUND OF THE INVENTION

This invention relates to a liquefied gas lighter with a ball-pointed pen and more particularly, to a liquefied gas lighter which comprises the fuel reservoir having a ball-pointed pen casing integrally and detachably connected thereto.

There have been proposed and practically employed a variety of liquefied gas lighters having ball-pointed pens detachably attached thereto. In one of such prior art gas lighters, the interior of the fuel reservoir is divided into the fuel compartment and the ball-pointed pen compartment for receiving the shank of the ball-pointed pen and in another one of the prior art gas lighters of such a type, one side wall of the fuel compartment is formed with a vertical opening the opposing walls of which have engaging projections extending towards each other and the ball-pointed pen receiving compartment is formed with recesses for engaging the projections. However, the prior art gas lighters are complicate in construction and require a time consuming procedure in assembling the components together resulting in expensive gas lighters.

SUMMARY OF THE INVENTION

Therefore, one object of the present invention is to provide a liquefied gas lighter with a ball-pointed pen which can effectively eliminate the disadvantages inherent in the prior art liquefied gas lighters of such a type referred to hereinabove.

Another object of the present invention is to provide a liquefied gas lighter with a ball-pointed pen which is simpler in construction and operation.

Another object of the present invention is to provide a liquefied gas lighter with a ball-pointed pen which requires a relatively smaller number of components and is less expensive.

Another object of the present invention is to provide a liquefied gas lighter which essentially comprises a housing defining a fuel reservoir therein having an engaging projection extending along one side, a ball-pointed pen casing detachably connected to the fuel reservoir and having in one side thereof a mating recess for receiving the engaging projection of the reservoir and a guide slot in the side opposite from the one side, a ball-pointed pen received in the casing for movement in the opposite directions and including a core, a ball pen point at the lower end of the core and a sleeve member surrounding the core, and a pen pusher member slidably received on an upper portion of the core and having an operation handle extending therefrom outwardly through the guide slot outside of the casing.

For attaining the objects, according to the present invention, there has been provided a liquefied gas lighter with a ball-pointed pen which comprises a housing defining a fuel reservoir therein, a cap secured to one end of said housing, an ignition wheel rotatably supported in said cap, a spring-loaded thumb plate and a flame height adjusting member for movement within a slot in said cap, characterized by an engaging projection extending along one side wall of said fuel reservoir, a ball-pointed pen casing detachably connected to said fuel reservoir and having a recess extending along one side wall of the casing for receiving said engaging projection on the fuel reservoir and a guide slot extending by a distance from one end of a second side wall of the casing, a ball-pointed pen received within said casing for movement between two positions, and a pen pusher member slidably received on a portion of said ball-pointed pen for movement between two positions.

The above and other objects and attendant advantages of the present invention will be readily apparent to those skilled in the art from a reading of the following detailed description in conjunction with the accompanying drawing which shows one preferred embodiment of the invention for illustration purpose only, but not for limiting the scope of the same in any way.

BRIEF DESCRIPTION OF THE DRAWINGS

The accompanying drawing shows the preferred embodiment of the liquefied gas lighter with a ball-pointed pen constructed in accordance with the principle of the invention in which.

PREFERRED EMBODIMENT OF THE INVENTION

The present invention will be now described referring to the accompanying drawing which shows one preferred embodiment of the lighter with a ball-pointed pen constructed in accordance with the present invention for illustration purpose.

Figure 1:
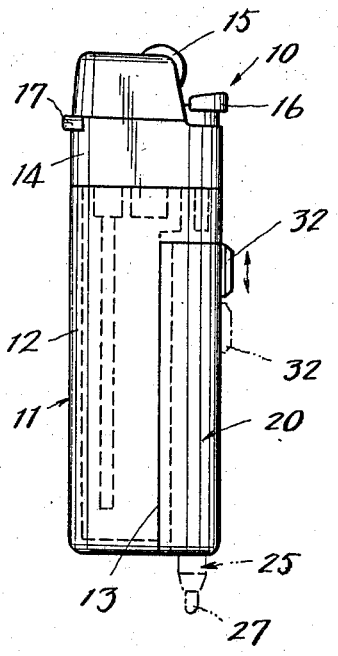
FIG. 1 is a side elevational view of the liquefied gas lighter with a ball-pointed pen of the invention.
Figure 2:
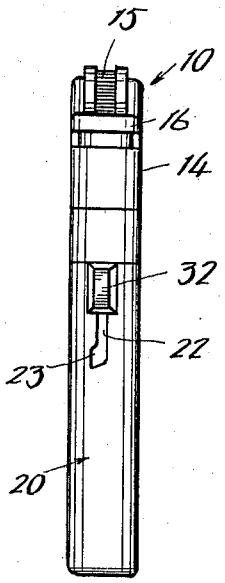
FIG. 2 is an end elevation view of the lighter as shown in FIG. 1.

The lighter with a ball-pointed pen is generally shown by reference numeral 10 and generally comprises a housing 11 which defines a fuel reservoir 12 therein holding a supply of liquefied gas under pressure. The fuel reservoir 12 is formed on one side wall (the right-hand side wall as seen in FIG. 1) with an engaging projection 13 extending from the lower end and terminating short of the top of the reservoir. The lighter 10 further includes a cap 14 secured to the top of the housing 11, an ignition wheel 15 rotatably supported in the cap 14, a spring-loaded thumb plate 16 attached to the cap 14 for vertical movement by a limited distance and normally urged upwardly under the force of the spring (not shown) within the housing and cap assembly to close the gas spouting nozzle (not shown) and adapted to open the nozzle when the thumb plate is depressed down by the user's thumb and a flame height adjusting member 17 for horizontal movement within the slot (not shown) formed in the cap 14 for adjusting the flame height or gas spouting amount.

The construction and function of the components of the lighter so far described hereinabove is substantially conventional in the art and further detailed description of these components will be omitted herein.

According to the present invention, the lighter is featured by the provision of a ball-pointed pen and its pusher member therein.

Figure 4:
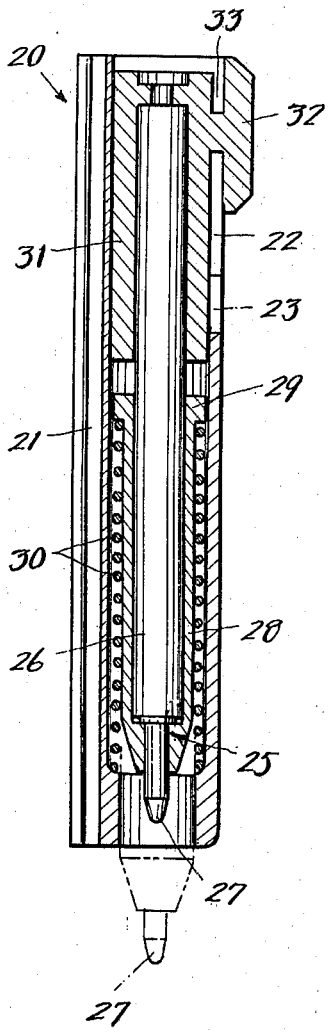
FIG. 4 is a vertically sectional view on an enlarged scale of the lighter showing the ball-pointed pen, the casing for receiving the ball-pointed pen and the pen pusher member.
Figure 3:
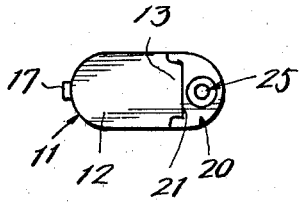
FIG. 3 is a bottom view of the lighter.

A ball-pointed pen casing 20 is detachably connected to the fuel reservoir 12 and formed on one side wall (the left-hand side wall as seen in FIG. 3) with a mating recess 21 extending along the side wall thereof for receiving the engaging projection 13 on the fuel reservoir 12. The casing 20 is further formed on the opposite side wall thereof (the right-hand side wall as seen in FIG. 4) with a vertically extending substantially L-shaped guide slot 22 which extends from the top of the associated side wall of the casing 20 by a distance and terminates at a substantially horizontal portion 23. The purpose of the L-shaped guide slot 22 will be described hereinafter.

A ball-pointed pen 25 is received in the casing 20 for vertical movement therein and integrally comprises a core 26, a ball pen point 27 at the lower end of the core 26 and a sleeve member 28 surrounding the core 26 in peripherally spaced relationship with the casing 20 and having an annular flange 29 at the top thereof. A coiled spring 30 surrounds a lower portion of the core 26 and abuts at the upper and lower ends thereof against the flange 29 on the sleeve member 28 and the bottom of the casing 20, respectively, to normally urge the ball-pointed pen 25 upwardly. A substantially cylindrical pen pusher member 31 is slidably fitted on an upper portion of the core 26 and has an integral operation handle 32 positioned outside of the housing 11 for accessible by the user and connected with the body of the pen pusher member 31 by means of an intermediate connecting portion 33 which also serves as the stopper for the pen 25. The lower end of the pen pusher member 31 is spaced from the top of the sleeve member 28. As will be understood from the description on the construction of the lighter hereinafter, the ball-pointed pen 25 is movable between a first or inoperative position in which the ball pen point 27 is retracted within the casing 20 and held therein under the force of the spring 30 as shown by the solid line in FIG. 4 and a second or operative position in which the ball pen point 27 projects downwardly from the casing 20 as shown by the phantom line in FIGS. 1 and 4. Similarly, the cylindrical pusher member 31 is movable between a first or inoperative position in which the pusher member is not applied any manual force thereto as shown by the solid line in FIG. 1 and a second or operative position in which the pusher member is applied manual force to move down along the guide slot 22 in the casing 20 and held in position with the intermediate connecting portion 33 engaging in the horizontal portion 23 at the lower end of the guide slot 22 as shown by the phantom line in FIG. 1.

With the above-mentioned construction and arrangement of the components of the lighter of the invention, when the lighter 10 is operated for its ordinary use or spouting the liquefied gas from the fuel reservoir 12, the ball-pointed pen 25 is held in the first or inoperative position under the force of the spring 30 with the ball pen point 27 withdrawn in the casing 20. On the other hand, when the lighter is operated for the writing purpose, a manual force is applied to the operation handle 32 on the pusher member 31 to cause the pusher member 31 to abut against and push the sleeve member 28 and accordingly, the pen 25 down against the force of the spring 30. The application of the manual force continues until the intermediate connecting portion 33 aligns with the horizontal portion 23 of the L-shaped pusher member 31 and the pusher member is then turned in one direction to cause the intermediate portion to engage in the slot portion 23 whereupon the ball-pointed pen 25 assumes the second or operative position with the ball pen point 27 positioned in the position as shown by the phantom line in FIGS. 1 and 4. When the ball-pointed pen 25 is desired to be returned to the first or inoperative position after the writing operation, the pusher member 31 is turned in the reverse direction to disengage the operation handle 32 from the guide slot portion 23 and the pusher member 31 is then pulled upwardly to the first or inoperative position whereupon the ball-pointed pen 25 is urged to the first or inoperative position under the force of the spring 30.

As mentioned hereinabove, since the fuel reservoir 12 is provided with the engaging projection 12 on the one side wall thereof and the pen casing 20 is also provided with the mating recess 21 in the adjacent side wall thereof, the connection between the two components can be simplified and give a pleasant appearance to the lighter housing and enhances the commercial value of the lighter. In addition, the connection arrangement provided by the mating projection and recess ensures that the casing can be easily and positively connected to and disconnected from the fuel reservoir for replacement of the pen 25. In addition, the ball-pointed pen can be simply and easily extended out of and retracted into the casing by downwardly and upwardly moving the operation handle on the pen pusher member which is slidably received on the upper portion of the pen core. Still furthermore, when engaged in the horizontal portion of the L-shaped pen pusher member guide slot, the operation handle on the pusher member serves as the stopper for the ball-pointed pen so as to hold the pen in the operative position whereby the pen can be positively prevented from retracting into the casing while the pen is being used for writing. Finally, since the lighter comprises a relatively small number of components and simple in construction though the lighter functions for dual purposes, the lighter can be produced at less expense.

It should be understood that the foregoing description is only illustrative of the invention. Various alternatives and modifications of the structure and functional features of the lighter can be devised by those skilled in the art without departing from the invention. Accordingly, the present invention is intended to embrace all such alternatives, modifications and variances which fall within the spirit and scope of the appended claims.

What is claimed is:

1. In a liquified gas lighter with a ball-pointed pen having a housing defining a fuel reservoir therein, a cap secured to one end of said housing, an injection wheel rotatably supported in said cap, a spring-loaded thumb plate and a flame height adjusting member for movement within a slot in said cap, characterized by an engaging projection extending along one side wall of said fuel reservoir, a self-contained ball-pointed pen having a casing detachably connected to said fuel reservoir and having a recess extending along one side wall of the casing for receiving said engaging projection on the fuel reservoir and having a pen pusher member thereon, and said casing having a guide slot for said pen pusher member extending by a distance from one end of a second side wall of the casing, a ball-pointed pen slidable in said casing for movement between two positions, and said pen pusher member being connected to said pen and slidably fitted on said ball-pointed pen casing for moving said pen between said two positions.

2. The liquefied gas lighter with a ball-pointed pen as set forth in claim 1, in which said pen pusher member includes an integral operation handle connected to the body of the pusher member by means of an intermediate connecting portion and projecting outwardly from the pusher member body out of said housing and said guide slot has a substantially L-shaped configuration and terminates at one end as a retaining portion for receiving said intermediate portion of the pen pusher member for holding the pusher member in one of said two positions.

3. The liquefied gas lighter with a ball-pointed pen as set forth in claim 2, in which one of said two positions of the ball-pointed pen is the inoperative position in which the entire pen is withdrawn within said casing and the other of said two positions of the ball-pointed pen is the operative position in which the ball pen point of the pen extends out of the casing, and one of said two positions of the pen pusher member is the inoperative position in which the pusher member is not applied to manual force thereto and the other of said two positions of the pusher member is the operative position in which the intermediate connecting portion of the pusher member engages in said retaining portion of the L-shaped guide slot to hold the ball-pointed pen in said operative position.

4. The liquefied gas lighter with a ball-pointed pen as set forth in claim 3, further including a coiled spring surrounding said ball-pointed pen to urge the pen to the inoperative position.

5. The liquefied gas lighter with a ball-pointed pen as set forth in claim 4, in which said pusher member holds said ball-pointed pen in said operative position against the force of said spring.

6. The liquefied gas lighter with a ball-pointed pen as set forth in claim 1, in which said second side wall of the ball-pointed pen casing opposes said one side wall of the pen casing.

* * * * *